US005222551A

United States Patent [19]

Hasegawa et al.

[11] Patent Number: 5,222,551

[45] Date of Patent: Jun. 29, 1993

[54] LAMINATE-TYPE HEAT EXCHANGER

[75] Inventors: Euto Hasegawa, Kounan; Yoshiyuki Yamauchi; Masahiro Shimoya, both of Chita; Toshio Ohara, Kariya, all of Japan

[73] Assignee: Nippondenso Co., Ltd., Kariya, Japan

[21] Appl. No.: 979,774

[22] Filed: Nov. 20, 1992

[30] Foreign Application Priority Data

Nov. 22, 1991 [JP] Japan ..... 3-307953
Mar. 26, 1992 [JP] Japan ..... 4-68758

[51] Int. Cl.[5] ..... F28F 3/08
[52] U.S. Cl. ..... 165/167; 165/166
[58] Field of Search ..... 165/153, 166, 167

[56] References Cited

U.S. PATENT DOCUMENTS

| | | | |
|---|---|---|---|
| 3,360,038 | 12/1967 | Stampes | 165/166 |
| 4,047,359 | 10/1983 | Berger et al. | 165/167 |
| 4,162,703 | 7/1979 | Bosaeus | 165/167 |
| 4,653,581 | 3/1987 | Yogo et al. | 165/166 |
| 4,872,578 | 10/1989 | Fuerschbach et al. | 165/167 |
| 5,069,276 | 12/1991 | Seidel | 165/166 |

FOREIGN PATENT DOCUMENTS

| | | | |
|---|---|---|---|
| 1-25915 | 8/1989 | Japan . | |
| 2-127966 | 10/1990 | Japan . | |
| 3-164689 | 7/1991 | Japan | 165/153 |
| 4-1278 | 1/1992 | Japan . | |
| 2005398 | 4/1979 | United Kingdom | 165/167 |

*Primary Examiner*—Allen J. Flanigan
*Attorney, Agent, or Firm*—Cushman, Darby & Cushman

[57] ABSTRACT

A laminate-type heat exchanger having a plurality of component plates each having a flange and projection formed along the circumference thereof, raised portions and hollowed portions formed at both ends of an area surrounded by the projection and which define together reservoirs, respectively, and an intermediate wall formed in an area except for the raised and hollowed portions and which has a height equal to half of the flange and raised portions, the plates adjacent at one side being laminated one on another with one side of the plate set opposite to the same side of the adjacent one and brazed to each other at their respective flanges and hollowed portions while the plates adjacent at the other side being laminated one on another are brazed to each other at their respective projections and raised portions.

7 Claims, 13 Drawing Sheets

LAMINATE-TYPE HEAT EXCHANGER

BACKGROUND OF THE INVENTION

1. Field of the Invention

The present invention relates to a laminate-type heat exchanger suitable for use in a car air-conditioner or the like, and more particularly, to the improved structure of the laminate.

2. Description of the Prior Art

Well known heat exchangers used in car air-conditioners include heat exchangers comprising, laminated one on another, a plurality of plates having an excellent heat transfer coefficient. A typical laminate-type heat exchanger is known from the disclosure in, for example, Japanese Examined Utility Model Publication (Kokoku) No. 1-25915, in which the component plates of the laminate are adapted to define, when laminated one on another, a path for each heat exchange medium, that is, adjoining paths through which a high and low-temperature media are passed, respectively, so that a heat exchange takes place between the media because of their difference in temperature.

As described in the above-mentioned Publication, the conventional laminate-type heat exchanger is provided with gaskets of a rubber, soft synthetic resin or the like disposed along the circumferences of the plates and of the medium paths to prevent the heat exchange medium from leaking from between the plates, and engagement recesses are formed for positioning the gaskets in place. The laminate is formed by laminating a plurality of such plates one on another, passing bolts through the plates and tightening the bolts to securely compress the gaskets to each other to ensure the liquid tightness of the gaskets and to rigidly fix the plates to each other.

The above laminate-type heat exchanger structure consists of the plates, gaskets, bolts, etc. Generally, the conventional laminate-type heat exchanger has many parts and thus takes a correspondingly long time and much labor in assembling the parts into a product.

Other types of heat exchangers than the above-mentioned laminate-type heat exchanger structure, such as a fin tube heat exchanger, have a structure of which the parts are assembled by brazing. When assembling the parts of a fin tube heat exchanger, for example, a plurality of heat conductive tubes and a plurality of corrugated fins are alternately held in place and a brazing filler metal is placed between these tubes and fins; then, they are put into a furnace as they are and are heated there so that the brazing filler metal is melted to join the tubes and fins to each other. Namely, this type of heat exchanger can be assembled without any gaskets, bolts and the like as in the laminate-type heat exchanger. This type is also advantageous in that many parts can be joined to each other at the same time, so that this assembling technique using brazing is suitable for mass production purposes. Thus more and more of the recent heat exchangers increasingly employ such a brazed-type structure.

Hence, the component plates should desirably be assembled by brazing also in the laminate-type exchanger. Many recent laminate-type heat exchangers use parts joined by brazing. Taking the junction between the parts into consideration, the laminate-type heat exchanger should desirably be formed by using the brazing technique.

SUMMARY OF THE INVENTION

The present invention has a primary object to overcome the above-mentioned drawbacks of the prior art by providing a laminate-type heat exchanger made of component plates of a reduced number of kinds, e.g., of only a single kind.

The present invention has another object to provide a laminate-type heat exchanger formed by assembling the component plates by brazing.

The present invention has a yet another object to provide a laminate-type heat exchanger having paths for a high and low-temperature media, respectively, defined between a plurality of laminated plates of which the flanges, hollowed and raised portions, projection, etc., abutted against each other, respectively, are brazed to each other, respectively.

The present invention has a still another object to provide a laminate-type heat exchanger formed from a reduced number of parts of a reduced number of kinds so that it is easy to assemble, its parts inventory and product quality can easily be controlled and it is suitable for mass production.

Other objects of the present invention will be easily apparent to those skilled in the art from the ensuing description of the present invention.

The above objects are accomplished by providing a laminate-type heat exchanger comprising a plurality of thermally conductive plates so laminated one on another as to define, between them, paths for a high and low-temperature media, respectively, between which a heat exchange is carried out through the plates, each of the plates being formed to have a flange formed along the circumference thereof, a projection formed along the flange, raised portions formed at ends of an area surrounded by the projection, each having the same height as the projection and which will form a part of a medium reservoir, hollowed portions formed adjacent to the raised portions, respectively, each having the same height as the flange and which will form another part of a medium reservoir, and an intermediate wall formed in a portion of the area surrounded by the projection except for the raised portions and followed portions and having a height equal to half of that of the flange and projection, the plurality of plates being laminated one on another by brazing the flange and hollowed portions of each plate to those of an adjoining plate at one side thereof, and brazing the projection and raised portions thereof to those of an adjoining plate at the other side thereof.

In accordance with the present invention, the plurality of plates is laminated one on another by brazing the flange and hollowed portions of each plate to those of an adjoining plate at one side thereof, and brazing the projection and raised portions thereof to those of an adjoining plate at the other side thereof. Thus the high and low-temperature heat exchange medium paths are formed in a space defined between the intermediate walls of these plate, and the projections opposing each other and the hollowed portions opposite to each other form together a medium reservoir. Therefore a plurality of such plates can be brazed to each other to form adjoining paths for media having different temperatures, respectively.

DETAILED DESCRIPTION OF THE PREFERRED EMBODIMENTS

Figure 1:
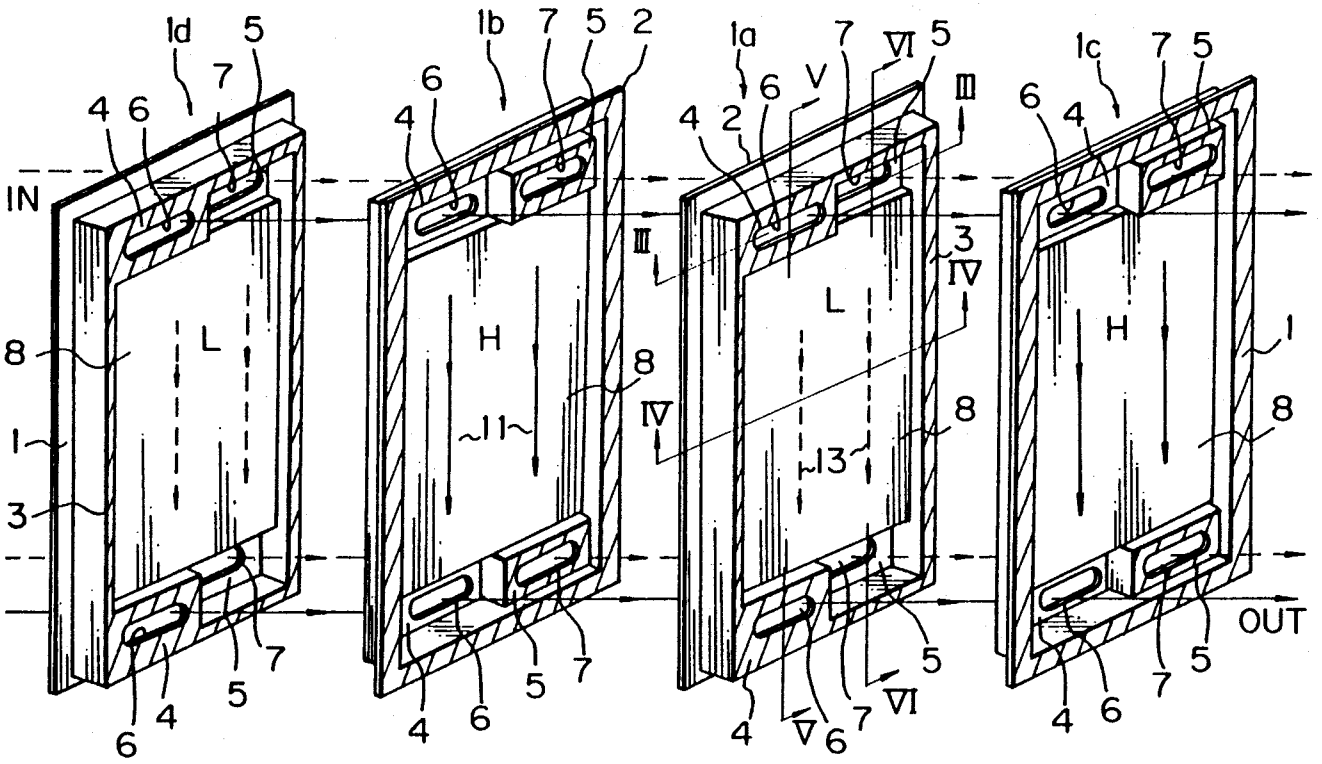
FIG. 1 is a perspective exploded view of a first embodiment of the laminate-type heat exchanger according to the present invention.

Referring now to FIGS. 1 through 6, the first embodiment of the laminate-type heat exchanger according to the present invention will be explained hereinbelow.

In Figures, the reference numerals 1*a* to 1*d* denote plates made of a metal excellent in heat transfer coefficient, such as aluminum or aluminum alloy. These plates 1*a* to 1*d* have an identical shape and are laminated one on another with one side of a plate set opposite to the same side of an adjacent one.

Figure 2A:
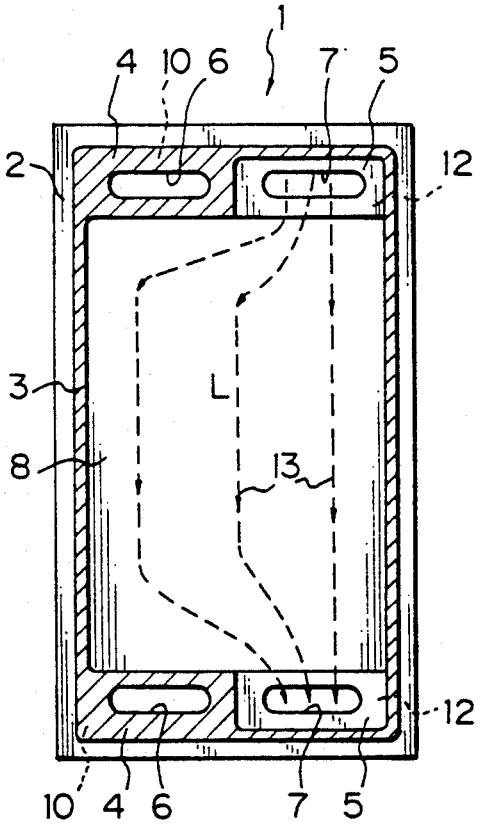
FIGS. 2A and 2B show the plate in the first embodiment, with FIG. 2A being a front view and FIG. 2B being a rear view.
Figure 2B:
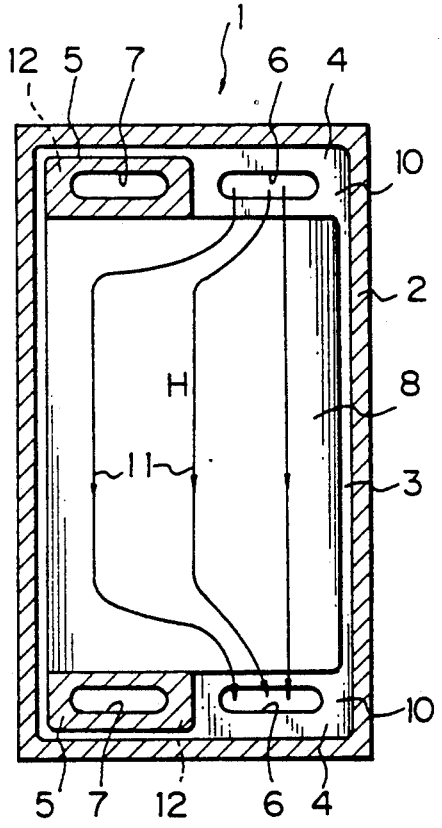
Figure 3A:
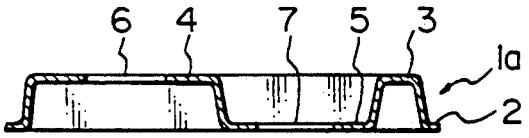
FIGS. 3A and 3B are a sectional view taken along the line III—III of FIG. 1, with FIG. 3A showing one plate and FIG. 3B showing a plurality of such plates joined to each other by brazing.
Figure 3B:
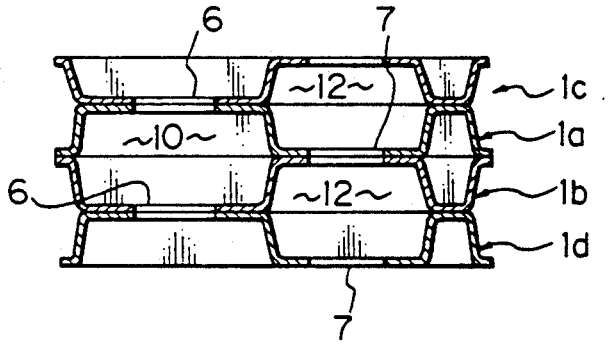
Figure 4A:
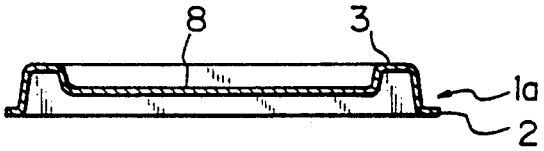
FIGS. 4A and 4B are also a sectional view taken along the line IV—IV in FIG. 1, with FIG. 4A showing one plate and FIG. 4B showing a plurality of such plates joined to each other by brazing.
Figure 4B:
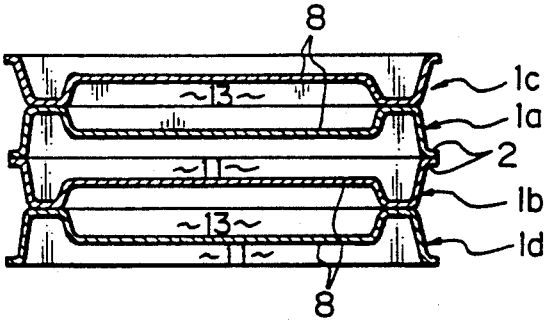
Figure 5A:
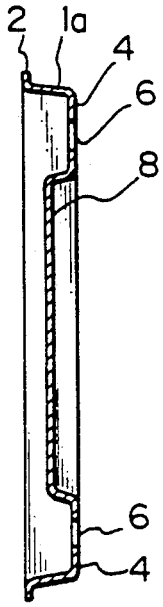
FIGS. 5A and 5B are a sectional view taken along the line V—V in FIG. 1, with FIG. 5A showing one plate and FIG. 5B showing a plurality of such plates joined to each other by brazing.
Figure 5B:
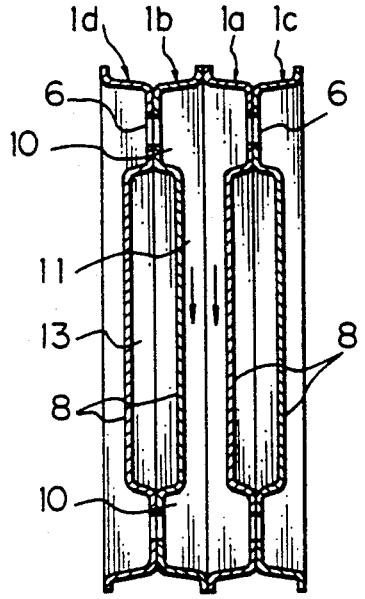
Figure 6A:
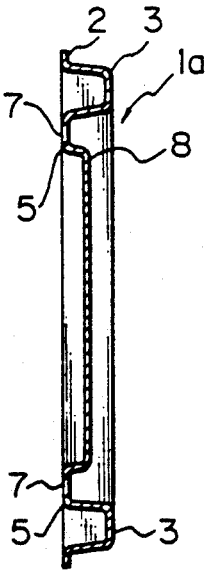
FIGS. 6A and 6B are a sectional view taken along the line VI—VI in FIG. 1, with FIG. 6A showing one plate and FIG. 6B showing a plurality of such plates joined to each other by brazing.
Figure 6B:
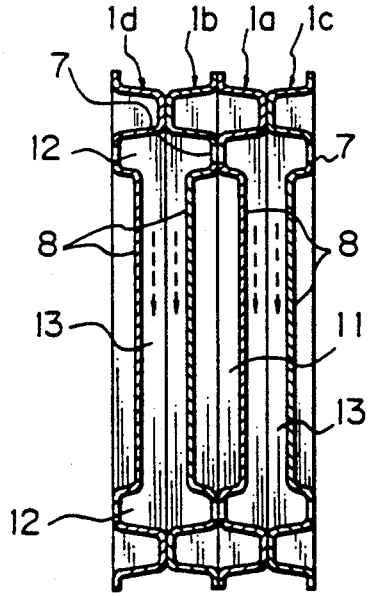
Figure 7:
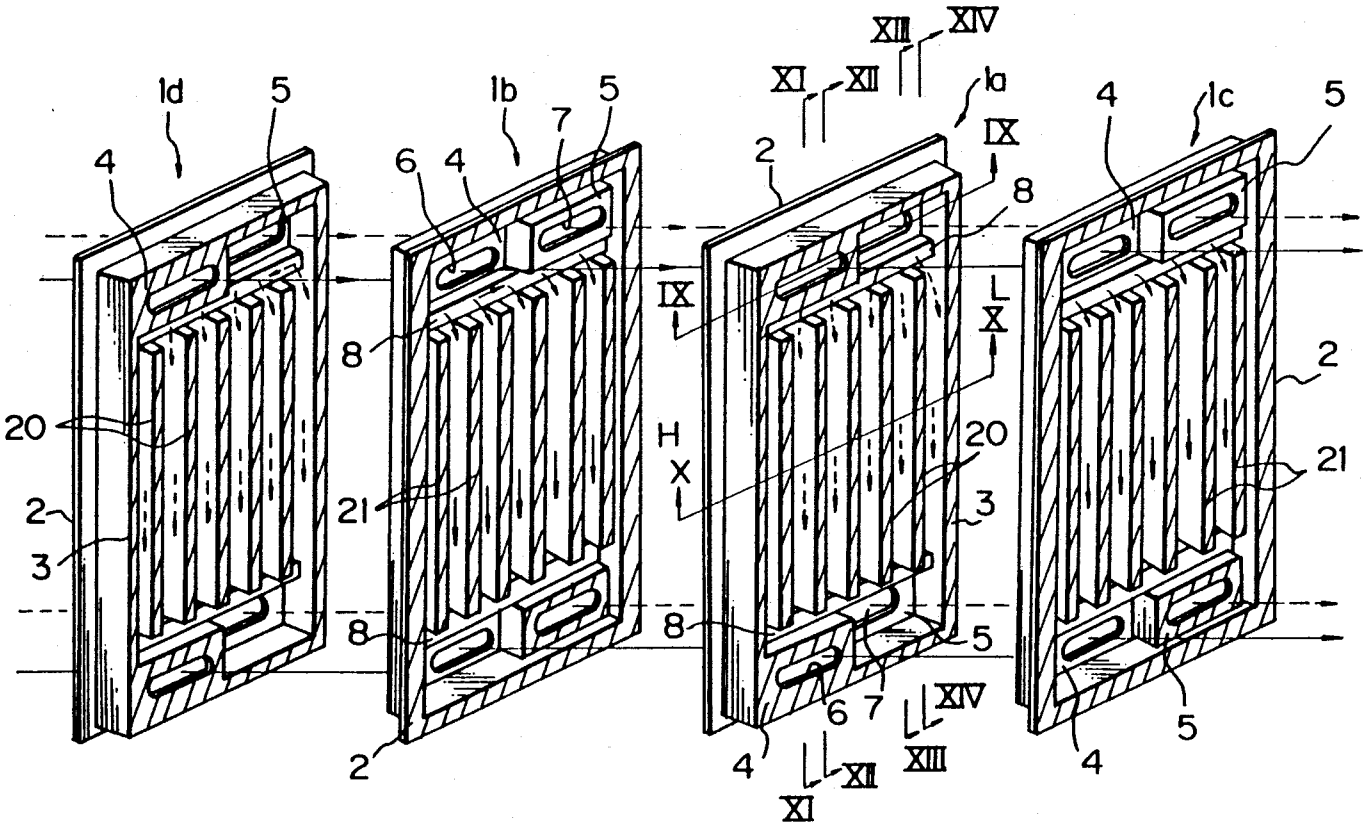
FIG. 7 is a perspective exploded view of a first embodiment of the laminate-type heat exchanger according to the present invention.
Figure 8A:
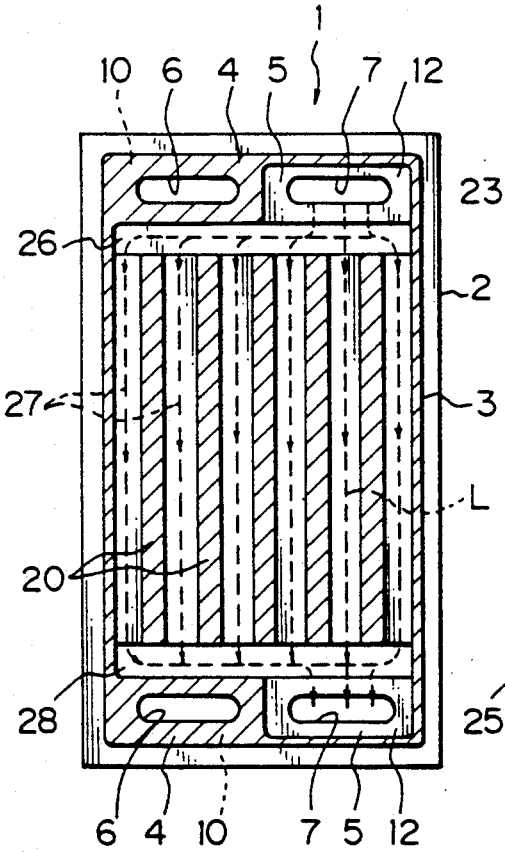
FIGS. 8A and 8B show the plate in the second embodiment, with FIG. 8A being a front view and FIG. 8B being a rear view.
Figure 8B:
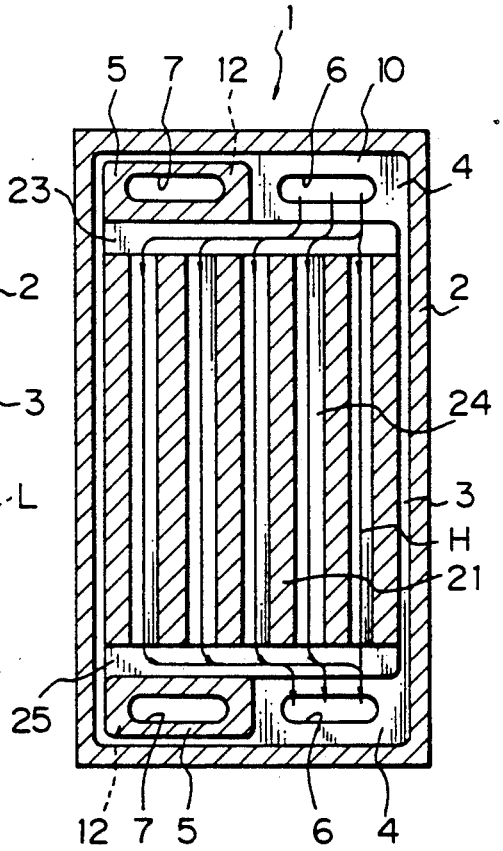
Figure 9A:
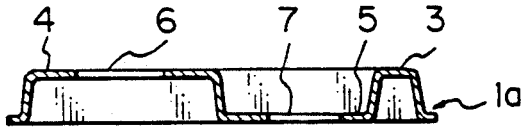
FIGS. 9A and 9B are a sectional view taken along the line IX—IX of FIG. 7, with FIG. 9A showing one plate and FIG. 9B showing a plurality of such plates joined to each other by brazing.
Figure 9B:
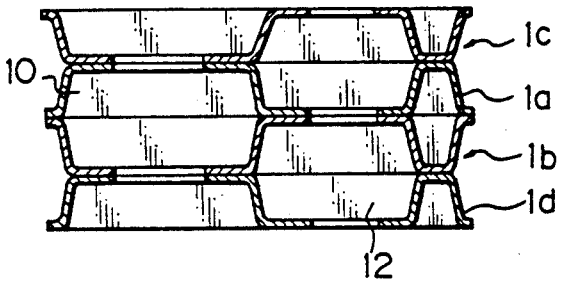
Figure 10A:
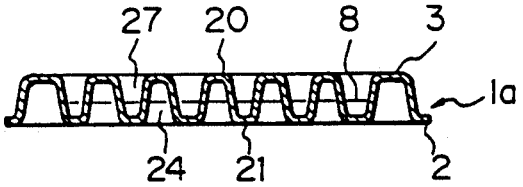
FIGS. 10A and 10B are also a sectional view taken along the line X—X in FIG. 7, with FIG. 10A showing one plate and FIG. 10B showing a plurality of such plates joined to each other by brazing.
Figure 10B:
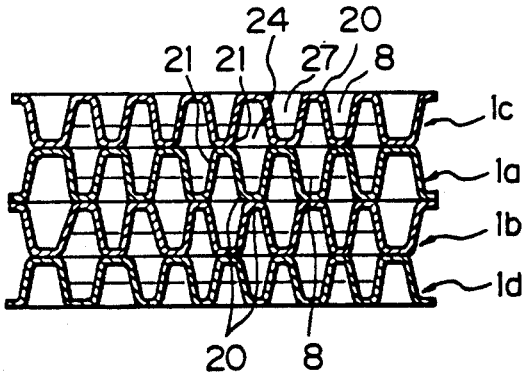
Figure 11A:
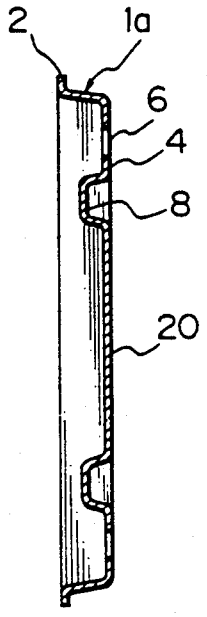
FIGS. 11A and 11B are a sectional view taken along the line XI—XI in FIG. 7, with FIG. 11A showing one plate and FIG. 11B showing a plurality of such plates joined to each other by brazing.
Figure 11B:
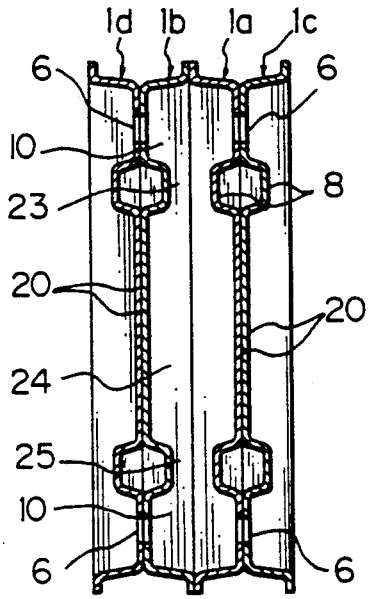
Figure 12A:
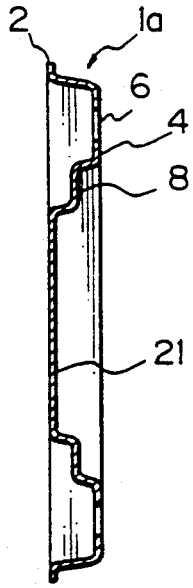
FIGS. 12A and 12B are a sectional view taken along the line XII—XII in FIG. 7, with FIG. 12A showing one plate and FIG. 12B showing a plurality of such plates joined to each other by brazing.
Figure 12B:
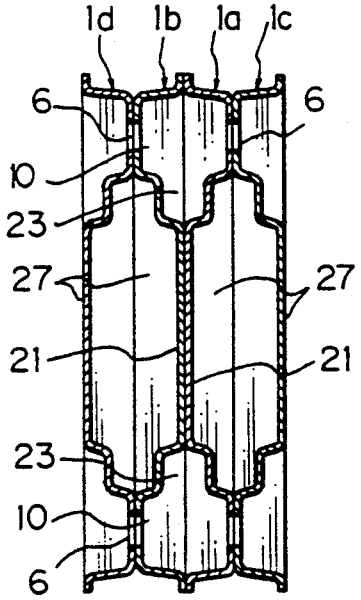
Figure 13A:
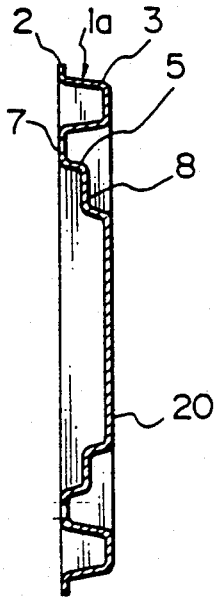
FIGS. 13A and 13B are a sectional view taken along the line XIII—XIII in FIG. 7, with FIG. 13A showing one plate and FIG. 13B showing a plurality of such plates joined to each other by brazing.
Figure 13B:
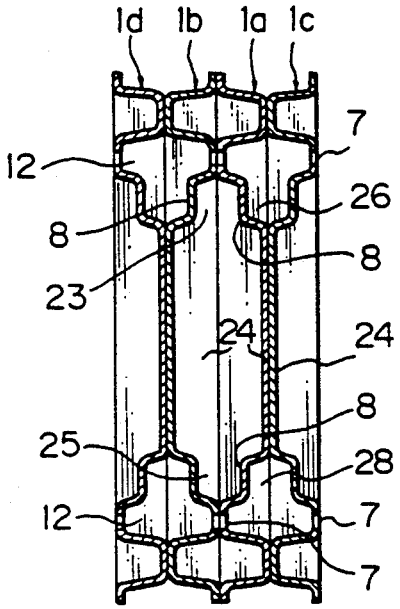
Figure 14A:
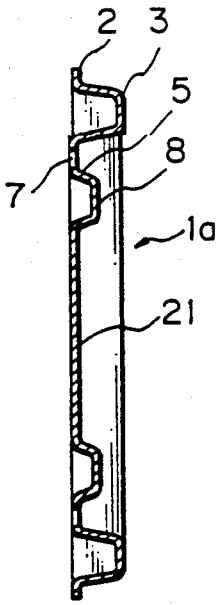
FIGS. 14A and 14B are also a sectional view taken along the line XIV—XIV in FIG. 7, with FIG. 14A showing one plate and FIG. 14B showing a plurality of such plates joined to each other by brazing.
Figure 14B:
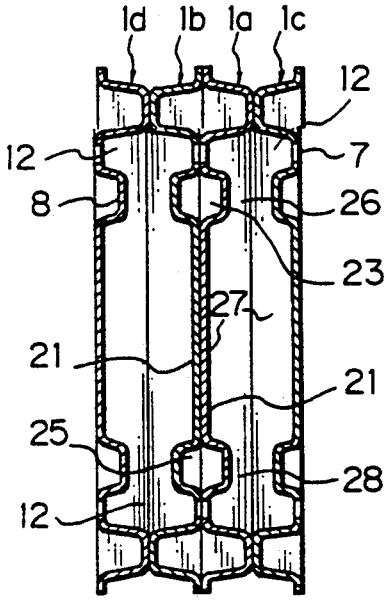

Each of the plates 1 has a structure as shown in FIG. 2. FIG. 2A is a front view and FIG. 2B is a rear view. As seen, each of the plates 1 has a rectangular shape having a flange 2 formed along the circumference thereof. The flange 2 has a predetermined width and is circumferentially continuous. The flange 2 has a circumferentially continuous projection 3 formed inside thereof. This portion 3 is a projection when viewed from the front side of the plate, but it is also a recess when viewed from the rear side.

There are formed raised portions 4 and hollowed portions 5 at the upper and lower ends, respectively, of an area surrounded by such projection 3.

The raised portions 4 project on the front side as viewed from the front and have the same height as the projection 3. Thus the top face of the raised portions 4 is flush with and contiguous to the projection 3. These raised portions 4 are formed symmetrically with respect to the horizontal midline of the plate 1.

The hollowed portions 5 are formed adjacent to the raised portions 4. These portions 5 are hollowed toward the rear side of the plate 1 as viewed from the front. The bottom of these followed portions 5 have the same height (depth) as the flange 2. Also these hollowed portions 5 are formed symmetrically with respect to the horizontal midline of the plate 1.

The raised portions 4 and hollowed portions 5 are generally identical in area to each other.

As shown, there are formed communication holes 6 and 7 through the top of the raised portions 4 and the bottom of the hollowed portions 5.

Furthermore, an intermediate wall 8 is formed in the area surrounded by the projection 3 except for the raised portions 4 and hollowed portions 5. This intermediate portion 8 has a height equal to half of the height of the flange 2 or projection 3, and it is shaped flat in this embodiment.

These plates 1 are laminated one on another with one side of a plate set opposite to the same side of an adjacent one and brazed to each other at the contact faces thereof.

The to-be-brazed contact faces are shown with hatch lines in FIGS. 1 and 2. Referring to the perspective exploded view in FIG. 1, a certain one plate 1*a* and an adjoining one 1*b* at the rear side thereof are in contact with each other at their respective flanges 2 and hollowed portions 5, and thus they are joined by brazing to each other at these portions.

The plate 1*a* and another plate 1*c* adjacent at the front side thereof are in contact with each other at their respective projections 3 and raised portions 4, and thus they are brazed to each other at such portions.

Similarly, the plate 1*b* and a plate 1*d* adjacent at the rear side thereof are brazed to each other at their respective projections 3 and raised portions 4.

A plurality of such plates 1 are laminated and brazed together as mentioned above to assemble the laminate-type heat exchanger of the present invention.

In this-embodiment, as shown in the sectional views in FIGS. 3B to 6B showing the laminated state of the plates 1, the plate 1*a* and the plate 1*b* adjacent to the plate 1*a* are set next to each other with their raised portions 4 facing each other so that the raised portions 4 define, between them, a high-temperature medium reservoir 10 which supplies and recovers a heat exchange medium, for example, a high-temperature medium indicated with a solid-line arrow H, while the intermediate walls 8 and projections 3 define together a high-temperature medium path 11 providing a communication path between the upper and lower high-temperature medium reservoirs 10.

The plate 1*a* and another adjoining plate 1*c*, and the plates 1*b* and 1*d*, are set next to each other with their respective hollowed portions 5 being opposite to each other, so that the hollowed portions 5 define, between them, low-temperature medium reservoirs 12, respectively, each of which supplies and recovers a heat exchange medium for example, a low-temperature medium indicated with a broken-line arrow L, while the intermediate walls 8 and projections 3 define together low-temperature paths 13 which provide a communication path between the upper and lower low-temperature medium reservoirs 12.

The high-temperature medium reservoir 10 and low-temperature medium reservoir 12 are mutually separated from each other, and the high-temperature medium path 11 and low-temperature medium path 13 are separated from each other by the intermediate walls 8.

Each of the high-temperature medium reservoirs 10 defined by the laminated plates 1 communicate with each other by means of communication holes 6, while the low-temperature medium reservoirs 12 communicate with each other by means of communication holes 7.

Therefore, the high-temperature medium reservoirs 10, communicate with each other in the direction of lamination to form a heater for the high-temperature medium, while the low-temperature medium reservoirs 12 communicate with each other also in the direction of lamination to form a header for the low-temperature medium.

In the laminate-type heat exchanger having the above-mentioned structure, the high-temperature medium H is distributed to each of the high-temperature medium paths 11 through the upper reservoir 10 and discharged from the lower reservoir 10. Also, the low-temperature medium L is distributed to each of the low-temperature medium paths 13 from the upper reservoir 12 and discharged through the lower reservoir 12.

While these heat exchange media are passing through the paths 11 and 13, heat transfer is carried out between them through the intermediate wall 8 separating the paths 11 and 13 from each other and thus a heat exchange is effected.

In this embodiment, since the high-temperature medium paths 11 and low-temperature medium paths 13 are identical in cross-sectional area, the flow rates can be made same between the media H and L through the paths 11 and 13. Further, since the paths 11 and 13 are only separated from each other by a single intermediate wall 8, the heat can be transferred efficiently and thus a high coefficient of heat exchange can be attained.

The heat exchanger of this structure can be simply assembled with the plurality of plates laminated one on another and brazed to each other. Therefore, no special coupling members such as bolts or the like are required for assembling the component plates, which reduces the amount of labor required for assembling and also facilitates the manufacture of the heat exchanger.

In this embodiment, the flange 2 formed along the circumference of the plates 1, the projection 3 formed circumferentially and continuously inside the flange 2, raised portions 4 and hollowed portions 5 formed at ends of an area surrounded by the projection 3 are designed to be symmetrical with respect to the horizontal midline of the plate, so that plates of one kind can be used to assemble a heat exchanger.

Further, the high-temperature medium path 11 and low-temperature medium path 13 are not only alternately formed in the neighboring plates, but the raised portions 4 and hollowed portions 5 are formed integrally with each other, so that the reservoirs 10 for distributing the heat exchange media to the high-temperature medium path 11 and low-temperature medium path 13 and the reservoirs 12 for recovering the media from these paths can be formed integrally with each other.

Therefore, the laminate-type heat exchanger can be made from the component plates of a single kind, and the plates can be easily formed by pressing, which will facilitate, in conjunction with the reduced number of plate kinds, production, assembly and parts inventory management.

It should be noted that the present invention is not limited only to the embodiment as described in the foregoing.

FIGS. 7 through 14 show a second embodiment of the present invention. In these Figures, the same elements as in the first embodiment will be denoted with the same reference numerals as in the first embodiment.

The second embodiment is different from the first one in that straight ribs 20 and 21 are formed on the intermediate wall 8 as shown.

In this second embodiment, the intermediate wall 8 has formed thereon ribs 20 and 21 spaced at predetermined intervals in the direction of the plate depth and which extend downward. The ribs 20 have the same height as the projection 3 while the ribs 21 have the same height as the flange 2. These ribs 20 and 21 are also recesses when viewed from the opposite side, respectively, and they are alternately arranged. Therefore, the intermediate wall 8 assumes a wave shape due to these ribs 20 and 21.

The upper and lower ends of the ribs 20 and 21 are discontinuous from the raised portions 4 and hollowed portions 5 because of the intermediate walls 8 formed between them. There are also formed branching paths 23, 25, 26 and 28 in the discontinuous zones.

In the case of this heat exchanger structure, the adjoining plates 1*a* and 1*b* are brazed to each other at their respective flanges 2, hollowed portions 5 and ribs 21. The other adjoining plates 1*a* and 1*c* are brazed to each other at their respective projections 3, raised portions 4 and ribs 20.

Therefore, in this embodiment, the area of contact between the thus laminated plates is increased so that the heat exchanger will have an increased mechanical strength.

The high-temperature medium H supplied to the upper reservoir 10 flows as branched through the narrow branching paths 23 maintained by the intermediate wall 8, goes as branched to the narrow branching paths 24 defined between the ribs 21, and having passed through the paths 24, the branch flows of the medium H join together in the bottom reservoir 10 through the bottom branching path 25.

On the other hand, the low-temperature medium L supplied to the upper reservoir 12 flows as distributed through the upper branching path 26 maintained by the intermediate wall 8, goes as branched to the narrow branching paths 27 defined between the ribs 20, and having passed through the paths 27, the branch flows of the medium L join together in the lower reservoir 12 through the lower branching path 28.

While the high-temperature medium H and low-temperature medium L are flowing through the narrow branching paths 24 and 27, respectively, the heat is exchanged through the walls of these paths. In this embodiment, the waving of the ribs 20 and 21 increases the area of contact of the high-temperature medium H and low-temperature medium L with the walls of the paths so that a higher coefficient of heat exchange can be attained.

Also in this embodiment, all the portions of the plates are symmetrical with respect to the horizontal midline. Thus the heat exchanger can be formed from plates of a single kind, which also will facilitate production, assembly and parts inventory management.

Figure 15:
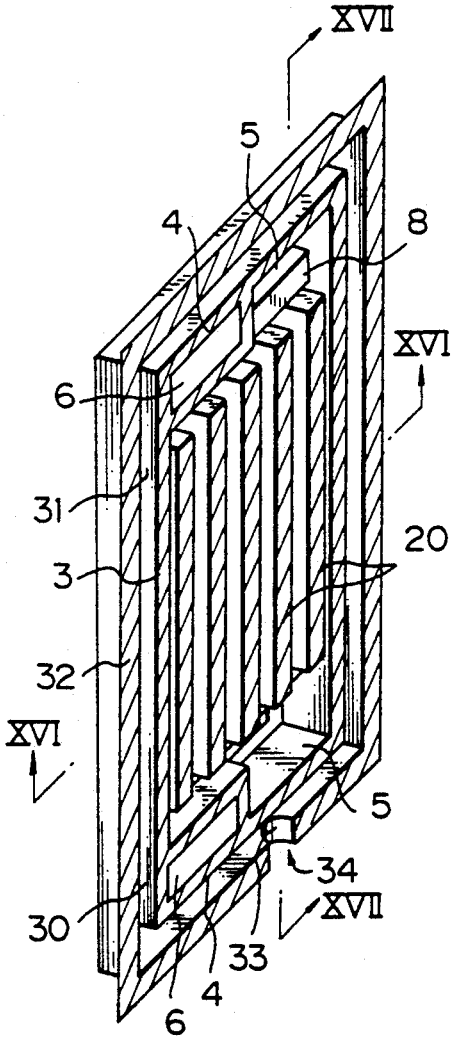
FIG. 15 is a perspective view of a third embodiment of the present invention.
Figure 16A:
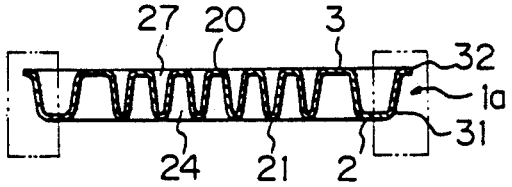
FIGS. 16A and 16B are a sectional view taken along the line XVI—XVI in FIG. 15, with FIG. 16A showing one plate and FIG. 16B showing a plurality of such plates joined to each other by brazing.
Figure 16B:
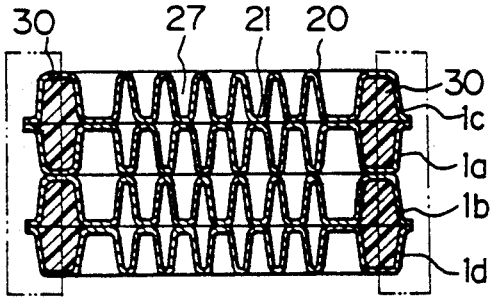
Figure 17A:
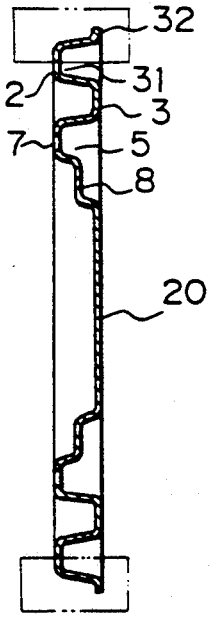
FIGS. 17A and 17B are also a sectional view taken along the line XVII—XVII in FIG. 15, with FIG. 17A showing one plate and FIG. 17B showing a plurality of such plates joined to each other by brazing.
Figure 17B:
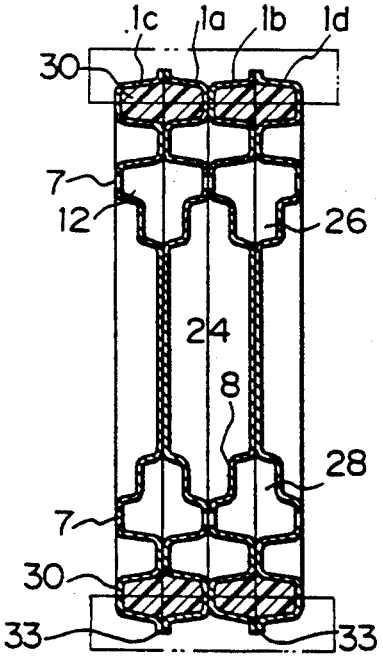

FIGS. 15 through 17 shows a third embodiment of the present invention. In these Figures, the same elements as in the second embodiment will be denoted with the same reference numerals as in the second embodiment.

The third embodiment is different from the second one in that heat insulation spaces 30 are defined along the circumference of the heat exchanger. More particularly, each of the plates 1 has a recess 31 formed therein contiguous to the flange 2 formed along the circumference thereof. The recess 31 takes the flange 2 as a bottom wall thereof and extending along the flange 2, and surrounds the projection 3. There is formed an auxiliary flange 32 contiguously to and along the open edge of the outer circumference of the recess 31. The auxiliary flange 32 acts substantially as the flange of the heat exchanger. Note that the auxiliary flange 32 has the same height as the projection 3. Thus, the portions shown as enclosed with imaginary lines in FIGS. 16 and 17 have different structures from those in the second embodiment. More particularly, such portions are formed extending out from the plate in the second embodiment.

When the adjoining plates 1*a* to 1*d* of the above-mentioned structure are laminated one on another and brazed to each other, the auxiliary flanges 32 are joined to each other so that the recesses 31 defined inside the auxiliary flange 32 form together a space 30 which will surround the projection 3. Namely, the space 30 will surround the medium (refrigerant) paths defined inside the projection 3. It should be noted that the space 30 communicates with the outside by means of a through-hole 34 defined by a cut 33 (see FIG. 15) formed in the auxiliary flange 32. The through-hole 34 may be either closed or opened to the outside. In any case, the space 30 will provide heat insulation by air.

In this structure of the heat exchanger, the refrigerant path formed inside the projection 3 is surrounded by the heat insulation space 30, so that no water will be condensed on the surface of the heat exchanger, resulting in no water drops. More particularly, in the first and second embodiments as previously described, the path through which the low-temperature medium passes and the low-temperature medium reservoir 12 are only isolated from the atmosphere by the wall of the plate 1. So that water in the atmosphere will possibly be condensed on the wall of the plate 1, resulting in water drops. Such dewing will easily cause the plates to be corroded. In the case when the plates are designed thin specially for a lightweight design heat exchanger, they will be corroded in a short period with the result that the refrigerant may leak through corrosion-caused holes in the plates.

In the third embodiment, however, the low-temperature medium path 13 and low-temperature medium reservoir 12 are surrounded by the heat insulation space 30. In this case, since the plate walls around the path and reservoir 12 are isolated from the atmosphere by the heat insulation space 30, there will scarcely occur any temperature difference, which can prevent dewing of water in the atmosphere, thus preventing the plates of the heat exchanger from being corroded.

Note that the heat insulation space 30 may be made a vacuum space by evacuations the space 30 through the through-hole 34. Alternatively, the heat insulation space 30 may be filled with a heat insulation material such as synthetic resin or the like. In this case, the filled heat insulation material will prevent the refrigerant from coming into the heat insulation space 30 and also prevent the plates 1 from being deformed when they are subject to an external local force. Further, the heat insulation filler may be a swelling resin which will close any holes through which the refrigerant has leaked.

The through-hole 34 may be utilized as a degassing hole during vacuum brazing of the plates, and also as a hole for drainage of any water drops that collect in the case where the heat insulation space 30 is designed to be opened to the atmosphere.

According to the third embodiment, the plurality of ribs 20 and 21 are formed in the intermediate wall 8 as in the second embodiment, so that the plates 1 have an increased mechanical strength and the area of contact of the heat exchange media is increased, and thus a higher coefficient of heat exchange can be advantageously attained. Therefore, provision of different irregularities in the intermediate wall 8 from the ribs 20 and 21 will increase the mechanical strength of the plates 1 and improve the coefficient of heat exchange due to the increased surface area as compared with at least the first embodiment. In the case where the intermediate wall 8 is designed to have an irregular surface, variations of the intermediate wall 8 can be implemented such as the straight ribs 20 and 21 as in the second and third embodiments, inclined ribs 50 and 51 as in a fourth embodiment which will be described later with reference to FIG. 18, bent ribs, circular concave and convex shapes, etc.

Figure 18:
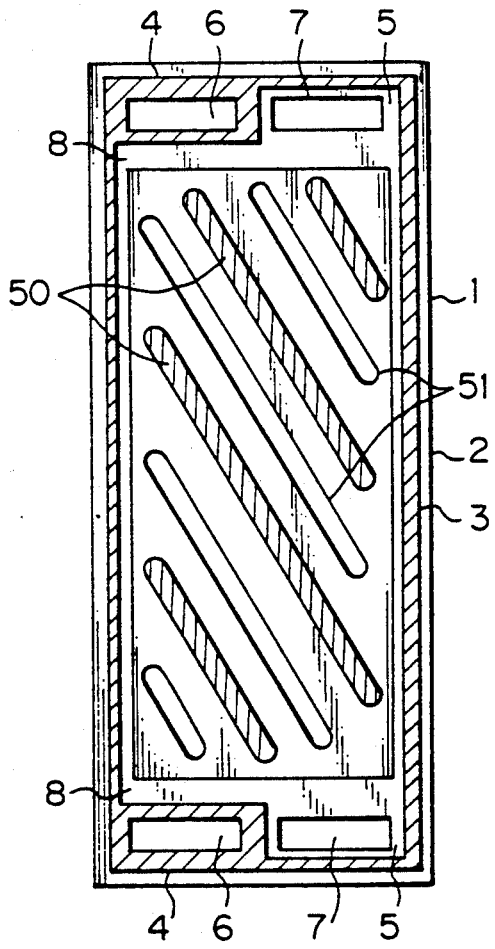
FIG. 18 is a front view of a fourth embodiment of the present invention.

FIG. 18 shows the fourth embodiment of the present invention in which the inclined ribs 50 and 51 are provided on the intermediate wall 8. In this embodiment, when the adjoining plates are brazed to each other, the area of contact between the ribs in smaller than in the second and third embodiments. More particularly, when the ribs are brazed to each other, a double wall is formed, reducing the coefficient of heat exchange. Accordingly, refrigerants of different temperature should desirably be put in contact with a single wall located between them. In the second and third embodiments, however, the area of contact between the ribs is such that the coefficient of heat exchange will possibly be lower. In the fourth embodiment shown in FIG. 18, however, the inclined ribs 50 and 51 minimize the area of contact between the ribs and increase the area of contact of the refrigerants having different temperatures with the single wall, thus improving the coefficient of heat exchange between such refrigerants. The inclination of the ribs permits a uniform distribution of contact points over the plate surface and maintains a high strength of junction between the plates.

In the previously mentioned embodiments, the flows of the high- and low-temperature media are indicated with the solid-line and broken-line arrows, respectively, but the flow directions of these media can be freely changed. More particularly, the communication holes 6 and 7 formed in the raised portions 4 and hollowed portions 5, respectively, in each of the embodiments can be closed or opened to change the flow directions of the media as necessary. For example, one of the media can be made to flow in a generally meandering manner while the other media flows in the opposite direction.

Some embodiments of the laminate-type heat exchanger according to the present invention have been described in detail in the foregoing.

Finally, one example application of the laminate-type heat exchanger according to the present invention will be described below for reference with reference to FIG. 19.

Figure 19:
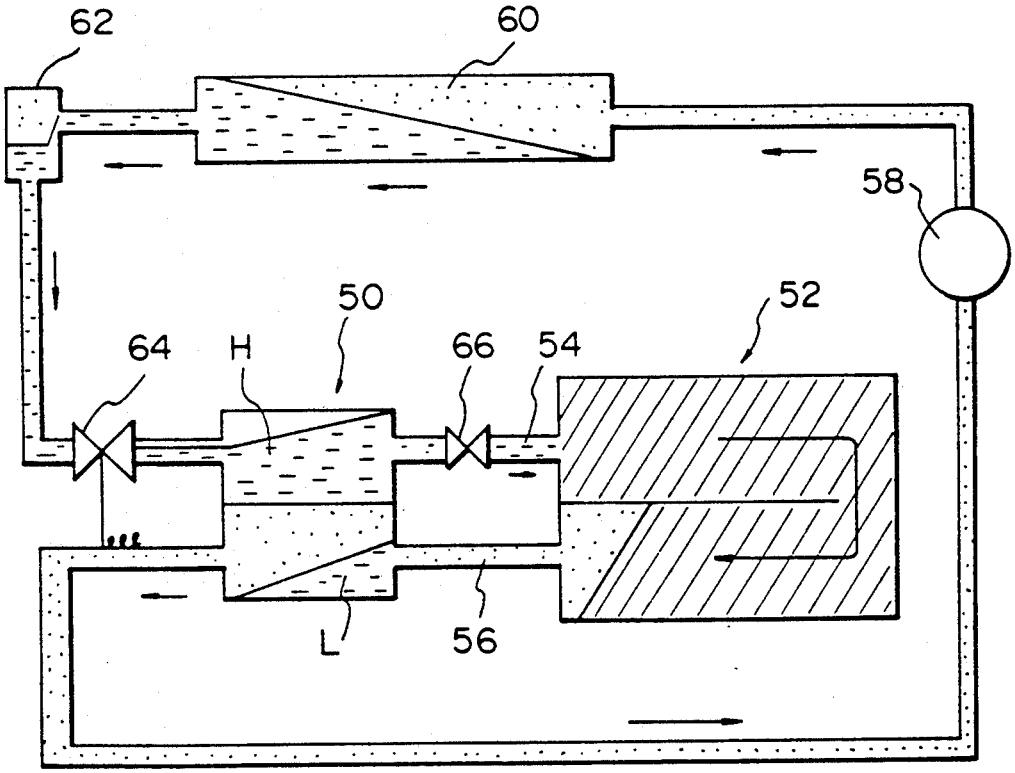
FIG. 19 is a diagram of a refrigerating cycle in which the laminate-type heat exchanger of the present invention is adopted as an example of application.

FIG. 19 shows an example application in which the laminate-type heat exchanger 50 is connected to an evaporator 52 used in the refrigerating cycle of a car air-conditioner. In this application, the laminate-type heat exchanger 50 according to the present invention is used in order for a heat exchange to take place between a high-temperature medium supplied to an inlet 54 of the evaporator 52 and a low-temperature medium discharged from an outlet 56. In FIG. 19, the reference numeral 58 denotes a compressor, 60 a condenser, 62 a receiver, 64 an expansion valve, and 66 a throttle valve, respectively. In this example, the surplus cooling power of the low-pressure, low-temperature media flowing out from the outlet 56 of the evaporator 52 and returning to the compressor 58 can be utilized to further enhance the efficiency of the refrigerating cycle.

We claim:

1. A laminate-type heat exchanger comprising a plurality of thermally conductive plates so laminated as to define, between them, paths for a high and low-temperature media, respectively, between which a heat exchange is carried out through the plates;

each of said plates being formed to have a flange formed along the circumference thereof, a projection formed along said flange, raised portions formed at ends of an area surrounded by said projection, each having the same height as said projection and forming a part of a medium reservoir, hollowed portions formed adjacent to said raised portions, respectively, each having the same height as said flange and forming another part of a medium reservoir, and an intermediate wall formed in a portion of said area surrounded by said projection except for said raised portions and hollowed portions and having a height equal to half of that from said flange to said projection, said plurality of plates being laminated one on another by brazing the flange and hollowed portions of each of said plates to those of an adjoining plate at one side thereof and said projection and raised portions thereof to those of an adjoining plate at the other side thereof.

2. A laminate-type heat exchanger as set forth in claim 1, wherein each of said plates is made of aluminum or an aluminum alloy.

3. A laminate-type heat exchanger as set forth in claim 1, wherein each of said plates has formed around said projection a recess taking said flange as the bottom and an auxiliary flange formed along the outer-circumferential open edge of said recess, each of said plurality of plates being brazed to an adjoining plate at one side at their respective recesses and hollowed portions and brazed to another adjoining plate at the other side at their respective auxiliary flanges, projections and raised portions, a space defined by said recesses formed around said projection between said adjoining plates forming a heat insulation space.

4. A laminate-type heat exchanger as set forth in claim 1, wherein there are formed concave and convex portions on said intermediate wall.

5. A laminate-type heat exchanger as set forth in claim 3, wherein there are formed concave and convex portions on said intermediate wall.

6. A laminate-type heat exchanger as set forth in claim 4, wherein said concave and convex portions formed on said intermediate wall take the form of a rib or recess.

7. A laminate-type heat exchanger as set forth in claim 5, wherein said concave and convex portions formed on said intermediate wall take the form of a rib or recess.

* * * * *